US010600349B2

(12) United States Patent
Cho et al.

(10) Patent No.: US 10,600,349 B2
(45) Date of Patent: Mar. 24, 2020

(54) DISPLAY APPARATUS AND DRIVING CIRCUIT THEREOF

(71) Applicant: SILICON WORKS CO., LTD., Daejeon (KR)

(72) Inventors: Hyun Ho Cho, Incheon-si (KR); Yong Ik Jung, Incheon (KR)

(73) Assignee: Silicon Works Co., Ltd., Daejeon (KR)

( * ) Notice: Subject to any disclaimer, the term of this patent is extended or adjusted under 35 U.S.C. 154(b) by 101 days.

(21) Appl. No.: 15/147,012

(22) Filed: May 5, 2016

(65) Prior Publication Data

US 2016/0335942 A1 Nov. 17, 2016

(30) Foreign Application Priority Data

May 14, 2015 (KR) ..... 10-2015-0067587

(51) Int. Cl.
*G09G 5/00* (2006.01)
*G09G 3/20* (2006.01)

(52) U.S. Cl.
CPC ..... *G09G 3/2007* (2013.01); *G09G 2310/027* (2013.01); *G09G 2310/0289* (2013.01); *G09G 2320/0276* (2013.01); *G09G 2330/021* (2013.01)

(58) Field of Classification Search
CPC ..... G09G 3/2007; G09G 2310/027; G09G 2310/0289; G09G 2320/0276; G09G 2330/021; G09G 3/3648; G09G 3/3233; G09G 2320/0233; G09G 2340/16; G09G 2360/16; G09G 2320/0295; G09G 2300/0452; G09G 2310/08; G09G 2370/08; G09G 2320/066; G09G 3/2074; G09G 3/2096; G09G 3/3266; G09G 2310/0264; G09G 2320/0247; G09G 2310/0235; G09G 2310/0286; G09G 2320/0252; G09G 2320/046; G09G 3/3696; G09G 2310/0291; G09G 2310/0297; G09G 2320/0209; G09G 2320/04; G09G 2320/043; G09G 2330/02; G09G 2320/0285; G09G 2320/0271; G09G 2320/0673; G09G 3/3275; G09G 3/3607;
(Continued)

(56) References Cited

U.S. PATENT DOCUMENTS 5,453,757 A * 9/1995 Date ..... G09G 3/2011 341/150
5,574,475 A * 11/1996 Callahan, Jr. ..... G09G 3/2011 345/100
(Continued)

FOREIGN PATENT DOCUMENTS

KR 10-0551738 2/2006
KR 10-0625544 9/2006
(Continued)

*Primary Examiner* — Duc Q Dinh
(74) *Attorney, Agent, or Firm* — Polsinelli PC

(57) ABSTRACT

The present invention relates to a display apparatus which drives a display panel to display an image, and a driving circuit thereof. The display apparatus includes a timing controller configured to provide a control option having a value for compensating for pixel data and a gray scale, and a driving circuit configured to combines the control option and the pixel data and output an output voltage.

15 Claims, 13 Drawing Sheets

(58) Field of Classification Search
CPC ..... G09G 2310/02; G09G 5/18; G09G 5/10; G09G 5/005
See application file for complete search history.

(56) References Cited

U.S. PATENT DOCUMENTS 5,644,329 A * 7/1997 Asari ..... G09G 3/3625 345/100
6,344,850 B1 * 2/2002 Okumura ..... G06F 3/1415 345/100
6,806,859 B1 * 10/2004 Kanoh ..... G09G 3/3688 345/100
8,072,398 B2 * 12/2011 Lee ..... G09G 3/3233 345/77
8,253,667 B2 * 8/2012 Sunohara ..... G09G 3/3688 345/87
8,605,125 B2 12/2013 Kim et al.
9,257,079 B2 * 2/2016 Zhao ..... G09G 3/3611
9,666,156 B2 * 5/2017 Tu ..... G09G 3/3696
2003/0063108 A1 * 4/2003 Isono ..... G09G 3/2011 345/690
2003/0201788 A1 * 10/2003 Sakaguchi ..... G09G 3/006 324/760.01
2004/0017341 A1 * 1/2004 Maki ..... G09G 3/3688 345/87
2004/0021627 A1 * 2/2004 Maki ..... G09G 3/3648 345/89
2005/0078079 A1 * 4/2005 Hashimoto ..... G09G 3/3283 345/100
2005/0140597 A1 * 6/2005 Lee ..... G09G 3/3233 345/76
2006/0164375 A1 * 7/2006 Kim ..... G09G 3/3685 345/100
2007/0182693 A1 * 8/2007 Kwon ..... G09G 3/2011 345/100
2008/0143658 A1 * 6/2008 Ishii ..... G09G 3/2011 345/87
2009/0009455 A1 * 1/2009 Kimura ..... G09G 3/2074 345/89
2010/0149151 A1 * 6/2010 Nam ..... G09G 3/3614 345/211
2010/0321412 A1 * 12/2010 Weng ..... G09G 3/3688 345/690
2011/0234570 A1 * 9/2011 Tsuchi ..... G09G 3/3275 345/211
2011/0242066 A1 * 10/2011 Jeon ..... G09G 3/20 345/204
2012/0249618 A1 * 10/2012 Sugiyama ..... H04L 25/49 345/691
2012/0262467 A1 * 10/2012 Yu ..... H04N 7/0105 345/531
2013/0342520 A1 * 12/2013 Tsuchi ..... G09G 3/3688 345/211
2014/0267444 A1 9/2014 Hwang et al.
2016/0117991 A1 * 4/2016 Ha ..... G09G 3/3291 345/78
2016/0351090 A1 * 12/2016 Jung ..... G09G 3/20

FOREIGN PATENT DOCUMENTS

KR 10-2006-0133727 12/2006
KR 10-2007-0063640 6/2007

* cited by examiner

DISPLAY APPARATUS AND DRIVING CIRCUIT THEREOF

BACKGROUND

1. Technical Field

The present disclosure relates to a display apparatus, and more particularly, to a display apparatus which is capable of expressing a gray scale with a larger number of gray scale values than the number of gray scale values which can be expressed by given pixel data.

2. Related Art

Various types of display apparatuses are continuously developed through a variety of technologies. The display apparatuses may be configured to express an image using an LCD (Liquid Crystal Display), PDP (Plasma Display Panel), OLED (Organic Light Emitting Diode) or AMOLED (Active Matrix Organic Light Emitting Diode).

Such display apparatuses include a timing controller and a driving circuit in order to express an image. The timing controller provides transmit (Tx) data corresponding to an input signal provided from outside to the driving circuit, and the Tx data may contain pixel data and a timing control signal. The driving circuit receives the Tx data transmitted from the timing controller, and drives a display panel in response to the pixel data and the timing control signal. The driving circuit may be manufactured as an individual chip, or the timing controller and the driving circuit may be manufactured as one chip.

The number of bits included in pixel data required for expressing one pixel needs to be increased in order to improve the image quality of the display panel. When the number of bits included in the pixel data is increased, the driving circuit must be operated at higher speed than when driving pixel data having a small number of bits. This means that the operation frequency of the driving circuit must be increased. Thus, when the number of bits included in the pixel data is increased, the power consumption of the driving circuit is inevitably increased.

Furthermore, in order to process pixel data having a large number of bits, the driving circuit has a complex configuration, and the chip must be manufactured to a large size. Thus, there are difficulties in designing the driving circuit, while the manufacturing cost is increased.

SUMMARY

Various embodiments are directed to a display apparatus capable of expressing a gray scale with a larger number of gray scale values than the number of gray scale values which can be expressed by pixel data, and a driving circuit thereof.

Also, various embodiments are directed to a display apparatus capable of implementing an image quality which is intended to be expressed, using pixel data having a smaller number of bits than the number of bits corresponding to gray scale values required for the image quality, and a driving circuit thereof.

Also, various embodiments are directed to a display apparatus capable of implementing a desired image quality at a low operation frequency by using pixel data having a smaller number of bits, thereby reducing power consumption of a driving circuit, and a driving circuit thereof.

Also, various embodiments are directed to a display apparatus capable of using pixel data having a small number of bits and thus implementing a driving circuit which can reduce a chip size, facilitate configuration and design, and reduce a manufacturing cost, and a driving circuit thereof.

In an embodiment, a display apparatus may include: a timing controller configured to provide pixel data and a control option; and a driving circuit configured to output an output voltage according to a combination of the pixel data and the control option, the output voltage having a gray scale including a larger number of gray scale values than the number of gray scale values expressed by the pixel data.

In another embodiment, a driving circuit of a display apparatus may include: a digital unit configured to perform a series of digital processes for pixel data and output a digital signal corresponding to the pixel data; and an analog unit configured to perform a series of analog processes corresponding to the digital signal and output an output voltage corresponding to the digital signal. At least any one of the digital unit and the analog unit may combine a control option and the pixel data, and the output voltage may have a gray scale including a larger number of gray scale values than the number of gray scale values expressed by the pixel data, according to a combination of the control option and the pixel data.

In another embodiment, a driving circuit of a display apparatus may include: a latch unit configured to latch at least pixel data and provide latch information; a level shifter unit configured to perform level-shifting on at least the latch information and output a digital signal; a gamma circuit configured to provide a gray voltage; a digital-analog converter configured to receive at least the output signal of the level shifter unit, select the gray voltage corresponding to the output signal of the level shifter unit, and output the selected gray voltage as an analog voltage; and a buffer unit configured to output the analog voltage as an output voltage. One of the latch unit, the level shifter unit, the gamma circuit, the digital-analog converter and the buffer unit may combine a control option and the pixel data. Among the latch unit, the level shifter unit, the gamma circuit, the digital-analog converter and the buffer unit, a circuit positioned before a combination of the control option and the pixel data may be configured to correspond to the number of bits included in the pixel data, and a circuit which combines the control option and the pixel data or performs an operation corresponding to the combination result may be configured to correspond to a larger number of bits than that of the pixel data.

In another embodiment, a driving circuit of a display apparatus may include: a digital unit configured to perform a series of digital processes for pixel data recovered therein and output a digital signal corresponding to the pixel data; and an analog unit configured to perform a series of analog processes corresponding to the digital signal and output an output voltage corresponding to the digital signal. The analog unit may include a digital-analog converter configured to select a gray voltage in response to the digital signal and output the selected gray voltage as an analog voltage. The digital-analog converter selects the gray voltage corresponding to the number of bits obtained by adding the digital signal and the control option and outputs the selected gray voltage as the analog voltage.

In another embodiment, a driving circuit of a display apparatus may include: a digital unit configured to perform a series of digital processes for pixel data recovered therein and output a digital signal corresponding to the pixel data; an analog unit configured to perform a series of analog processes corresponding to the digital signal and output an output voltage corresponding to the digital signal; and a control option providing unit configured to provide the control option. At least any one of the digital unit and the analog unit combines the control option and the pixel data.

DETAILED DESCRIPTION

Figure 1:
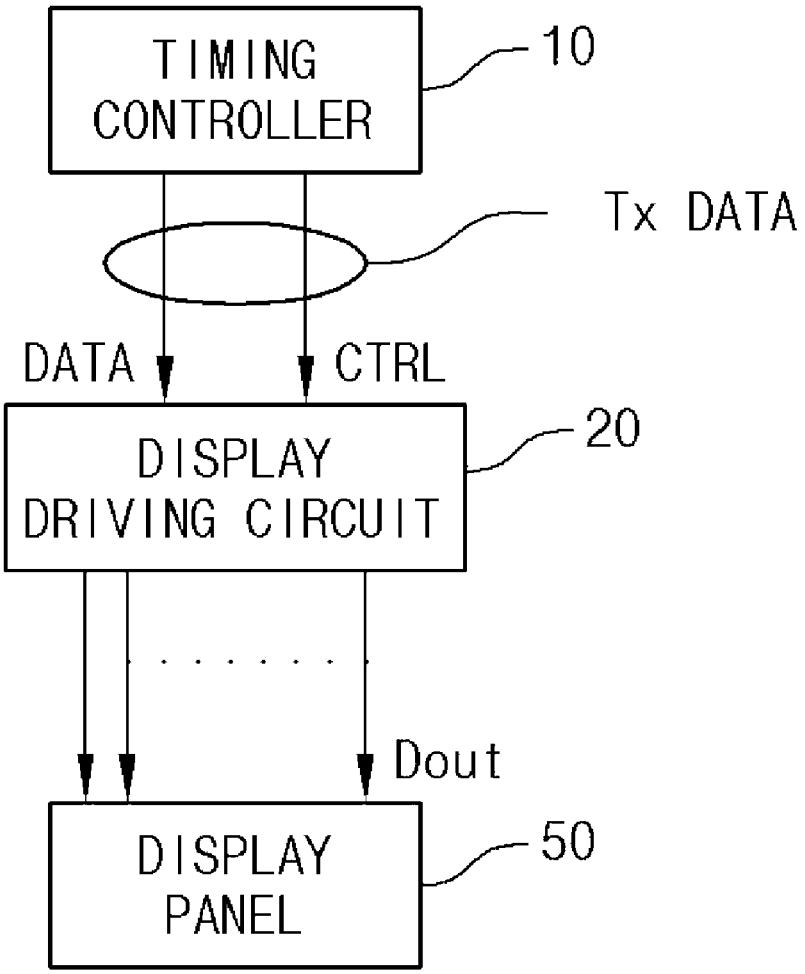
FIG. 1 is a block diagram illustrating a display apparatus according to an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

For example, 10-bit pixel data are needed in order to express a pixel as 1024 gray scale. The gray scale is used to distinguish the brightness of a pixel, and the 1024 gray scale indicate that a pixel is expressed at 1024-stage brightnesses. The 1024 gray scale may include 1024 gray scale values having different values from each other, and the gray scale values may be expressed as voltages. The embodiments of the present invention provide a technology for expressing a pixel with 1024 gray scale, using pixel data having a small number of bits than 10 bits or specifically 8-bit pixel data.

FIG. 1 is a block diagram illustrating a display apparatus according to an embodiment of the present invention.

The display apparatus according to the embodiment of the present invention includes a timing controller 10, a driving circuit 20 and a display panel 50.

The timing controller 10 outputs pixel data DATA and a control option CTRL in response to an input signal (not illustrated) received from outside.

The timing controller 10 may transmit the pixel data DATA and the control option CTRL in the form of a packet. The pixel data DATA and the control option CTRL, contained in the packet, may be implemented as one data stream. The pixel data DATA and the control option CTRL may be contained in Tx data and transmitted in series. The Tx data may include a timing control signal as well as the pixel data DATA and the control option CTRL, and the timing control signal may include a clock signal and the like.

The timing controller 10 may separately transmit the pixel data DATA and the control option CTRL. In this case, the pixel data DATA may be transmitted in the form of a packet, and the control option CTRL may be transmitted in the form of a pin option, separately from the pixel data DATA. The pin option may indicate that the control option CTRL is provided through a separate signal line and a pin of the driving circuit 20.

The display apparatus according to the present embodiment uses 8-bit pixel data and a 2-bit control option in order to express a pixel with 1,024 gray scale. Thus, the timing controller 10 provides 8-bit pixel data and a 2-bit control option to the driving circuit 20.

The driving circuit 20 receives the Tx data containing the pixel data DATA and the control option CTRL.

The driving circuit 20 generates an output voltage Dout using the 8-bit pixel data DATA and the 2-bit control option CTRL, and provides the output voltage Dout to the display panel 50. The driving circuit 20 may combine the 2-bit control option CTRL and the 8-bit pixel data DATA. According to the combination result, the driving circuit 20 may generate the output voltage Dout to express a gray scale corresponding to 10 bits in response to the 8-bit pixel data DATA.

More specifically, the 8-bit pixel data DATA cannot express pixels with 1024 gray-scale stages. Thus, the driving circuit 20 according to the present embodiment may combine the 8-bit pixel data DATA and the 2-bit control option, and express a pixel with a gray scale corresponding to 10 bits.

The display panel 50 receives the output voltage Dout for each pixel from the driving circuit 20, and displays a screen.

Figure 2:
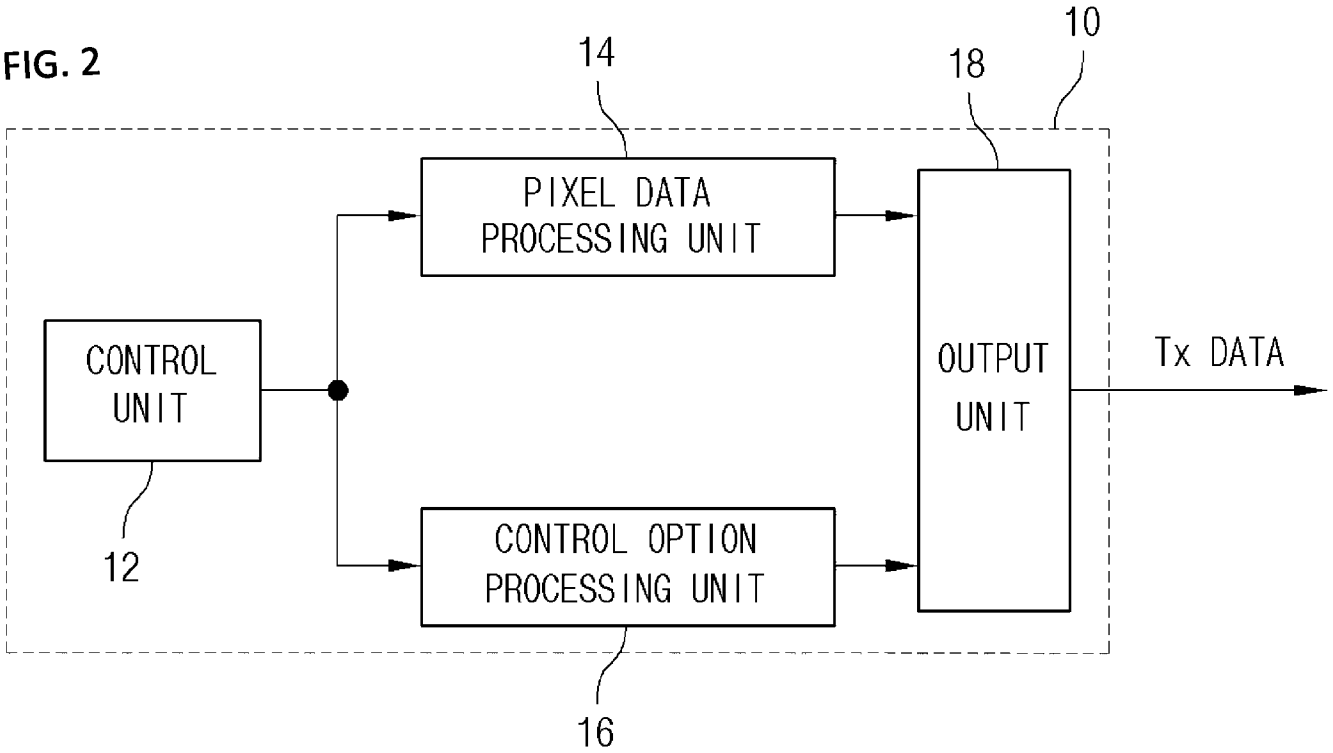
FIG. 2 is a block diagram illustrating a timing controller of FIG. 1.

FIG. 2 is a block diagram illustrating the timing controller 10 of FIG. 1.

The timing controller 10 may include a control unit 12, a pixel data processing unit 14, a control option processing unit 16 and an output unit 18.

The control unit 12 receives an input signal provided from outside. The control unit 12 divides pixel data and a control option which are contained in the input signal, provides the pixel data to the pixel data processing unit 14, and provides the control option to the control option processing unit 16. As described above, the input signal may include information for expressing a pixel with 10 bits, 8 bits of the 10-bit information may be divided into the pixel data, and 2 bits of the 10-bit information may be divided into the control option. The control option may set to 2 bits which are previously selected from the 10-bit information.

The pixel data processing unit 14 receives the 8-bit pixel data DATA in parallel from the control unit 12, converts the 8-bit pixel data DATA into serial data, and provides the serial data to the output unit 18.

The control option processing unit 16 receives the 2-bit control option CTRL in parallel from the control unit 12, converts the 2-bit control option into serial data, and provide the serial data to the output unit 18.

That is, each of the pixel data processing unit 14 and the control option processing unit 16 may include a parallel-serial converter for converting signals inputted in parallel into serial data.

The output unit 18 may receive the pixel data of the pixel data processing unit 14 and the control option CTRL of the control option processing unit 16, and provide Tx data in the form of a packet to the driving circuit 20, the Tx data containing the pixel data and the control option. The control option CTRL may be arranged at various positions. For example, the control option CTRL may be positioned at the front or rear of the pixel data DATA within the Tx data. In the present embodiment, the control option CTRL may be transmitted following the pixel data DATA.

FIG. 2 illustrates the configuration for transmitting Tx data in the form of a packet. On the other hand, when the control option CTRL is provided as a pin option to the driving circuit 20 through a separate signal line, the control option processing unit 16 may provide the control option CTRL to the driving circuit 20 through a separate signal line.

Figure 3:
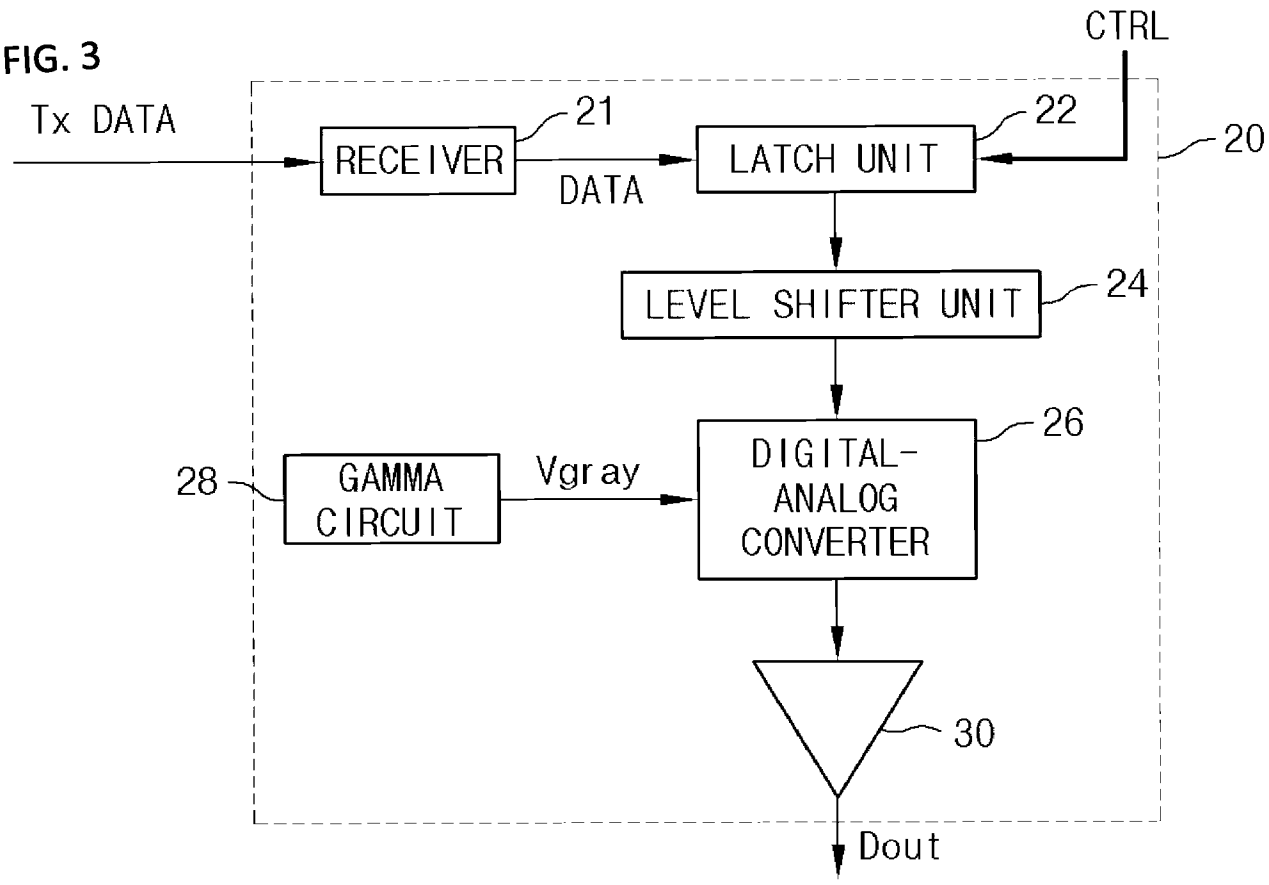
FIGS. 3 to 7 are block diagrams illustrating embodiments of a driving circuit of FIG. 1.
Figure 4:
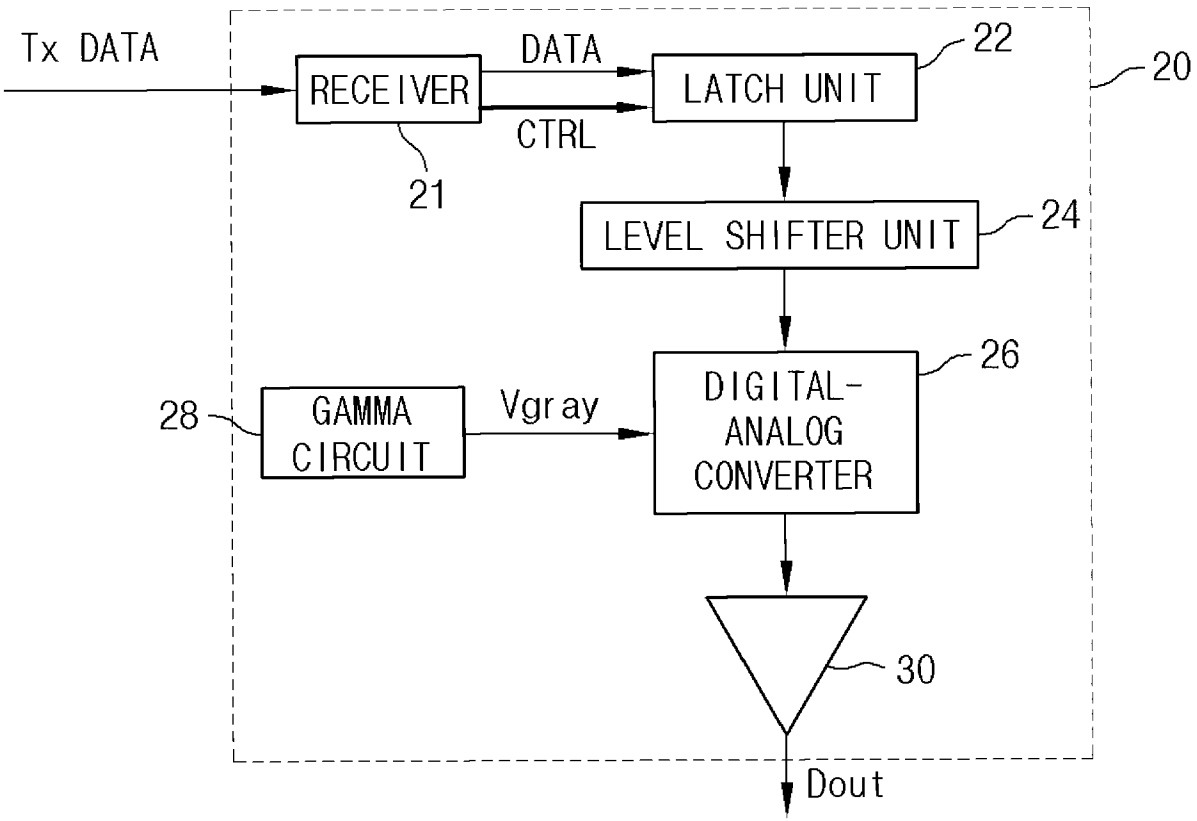

FIG. 3 illustrates that the control option CTRL is provided to the driving circuit 20 through a separate signal line, and FIG. 4 illustrates that the control option CTRL and the pixel data DATA are provided as a packet to the driving circuit 20. FIGS. 3 and 4 illustrate the same configuration except for the method for providing the control option CTRL. According to the configuration of FIGS. 3 and 4, the control option CTRL is applied to a latch unit 22, and a gray scale is changed by the latch unit 22. FIG. 3 illustrates that a receiver 21 provides only the pixel data DATA to the latch unit 22, and the latch unit 22 receives the pixel data DATA provided from the receiver 21 and the control option CTRL transmitted from the timing controller 10 through a signal line. FIG. 4 illustrates that the receiver 21 provides the pixel data DATA and the control option CTRL.

Referring to FIG. 3, the driving circuit 20 includes a receiver 21, a latch unit 22, a level shifter unit 24, a digital-analog converter 26, a gamma circuit 28 and a buffer unit 30.

The receiver 21 receives Tx data of the timing controller 10, recovers 8-bit pixel data DATA contained in the Tx data, and provides the recovered data to the latch unit 22.

The latch unit 22 includes latches (not illustrated) corresponding to 10 bits, stores the 8-bit pixel data DATA provided from the receiver 21 and the 2-bit control option CTRL provided from the timing controller 10 in the respective latches, and outputs 10-bit latch information in parallel to the level shifter unit 24. As described above, the latch unit 22 combines the 2-bit control option CTRL and the 8-bit pixel data DATA. As a result, the gray scale may be expressed as 10 bits obtained by combining the 8-bit pixel data DATA and the 2-bit control option CTRL. The latch unit 22 outputs the 10-bit latch information in which the pixel data DATA and the control option CTRL are combined. In response to the 10-bit latch information outputted from the latch unit 22, the level shifter unit 24, the digital-analog converter 26, the gamma circuit 28 and the buffer unit 30 are configured to process the 10-bit information.

The level shifter unit 24 transmits the 10-bit latch information provided from the latch unit 22 to the digital-analog converter 26, and the 10-bit latch information is level-shifted by the level shifter unit 24 and then outputted.

The digital-analog converter 26 selects a gray voltage Vgray corresponding to the 10-bit signal provided from the level shifter unit 24, and outputs the selected gray voltage to the buffer unit 30. At this time, the gamma circuit 28 provides gray voltages for expressing a 10-bit gray scale to the digital-analog converter 26.

The buffer unit 30 amplifies a voltage outputted from the digital-analog converter 26, and provides the amplified voltage to the display panel 50.

In the driving circuit 20, the latch unit 22 and the level shifter unit 24 may be defined as a digital unit which performs a series of digital processes for pixel data recovered in the driving circuit 20, and outputs a digital signal corresponding to the pixel data. The series of digital processes indicate a digital signal processing process including one or more of latching and level shifting. The digital-analog converter 26, the gamma circuit 28 and the buffer unit 30 may be defined as an analog unit which performs a series of analog processes corresponding to a digital signal and outputs an analog signal corresponding to the digital signal. The series of analog processes indicate an analog signal processing process which includes one or more of a level change of an analog voltage, a level change of a gamma voltage and a level change of an output voltage.

In the driving circuit 20 of FIG. 3, the pixel data DATA and the control option CTRL are combined in the latch unit 22. According to the value of the control option CTRL combined with the pixel data DATA, the latch unit 22 may output different latch information even when the same pixel data DATA are inputted.

More specifically, the control option CTRL may have four kinds of binary values such as $(00)_2$, $(01)_2$, $(10)_2$ and $(11)_2$. Thus, the latch unit 22 may output latch information to express four kinds of gray scales according to the binary values of the control option CTRL, in response to the 8-bit pixel data DATA having the same value. Therefore, the latch unit 22 may output the 10-bit latch information in which the 8-bit pixel data DATA and the 2-bit control option CTRL are combined, and the driving circuit may determine the output voltage Dout according to the 10-bit latch information outputted from the latch unit 22.

The driving circuit of FIG. 4 is different from the driving circuit of FIG. 3 in terms of the configuration of the receiver 21 and the method for providing the control option CTRL to the latch unit 22. While the components and operations of FIG. 4 are described, the duplicated descriptions of the same components and operations as those of FIG. 3 will be omitted.

In FIG. 4, the receiver 21 receives the Tx data from the timing controller 10, recovers the 8-bit pixel data DATA and the 2-bit control option CTRL which are contained in the Tx data, and provides the recovered data and control option to the latch unit 22.

As described with reference to FIG. 3, the latch unit 22 combines the 2-bit control option CTRL and the 8-bit pixel data DATA.

The driving circuits of FIGS. 3 and 4 can output the output voltage Dout according to the combination result of the 2-bit control option CTRL and the 8-bit pixel data, the output voltage Dout capable of expressing a gray scale with a larger number of gray scale values than the number of gray scale values which can be expressed through the given pixel data.

Furthermore, since the receiver 21 recovers pixel data having a small number of bits, the driving circuits can reduce the operation frequency and the power consumption, simplify the configuration and design of the delay circuit for recovering the pixel data of the receiver, improve the chip size, and reduce the manufacturing cost thereof.

Although not illustrated, the display apparatus according to the present embodiment may include a control option providing unit for providing the control option CTRL, unlike the driving circuits of FIGS. 3 and 4.

The control option providing unit may be configured in the driving circuit 20.

The control option providing unit may be configured to provide a control option in response to an external input. In this case, the control option providing unit may transmit the external input as the control option, or modify the external input and provide the modified signal as a control option. At this time, the external input may include a value set to the option signal.

The control option providing unit may be configured to generate a control option using a value set in the driving circuit 20 and provide the generated control option.

The control option providing unit may be configured to generate a control option using pixel data and provide the generated control option. In this case, the control option control unit may use a part of the pixel data.

The control option providing unit may be configured to provide a control option using a signal related to the recovery of pixel data. In this case, a clock signal, a delay signal or a control signal may be used in order to provide the control option.

FIGS. 5 to 12 illustrate driving circuits according to other embodiments of the present invention. The driving circuits of FIGS. 5 to 12 may include the configuration for transmitting the control option CTRL as a pin option or packet.

Figure 5:
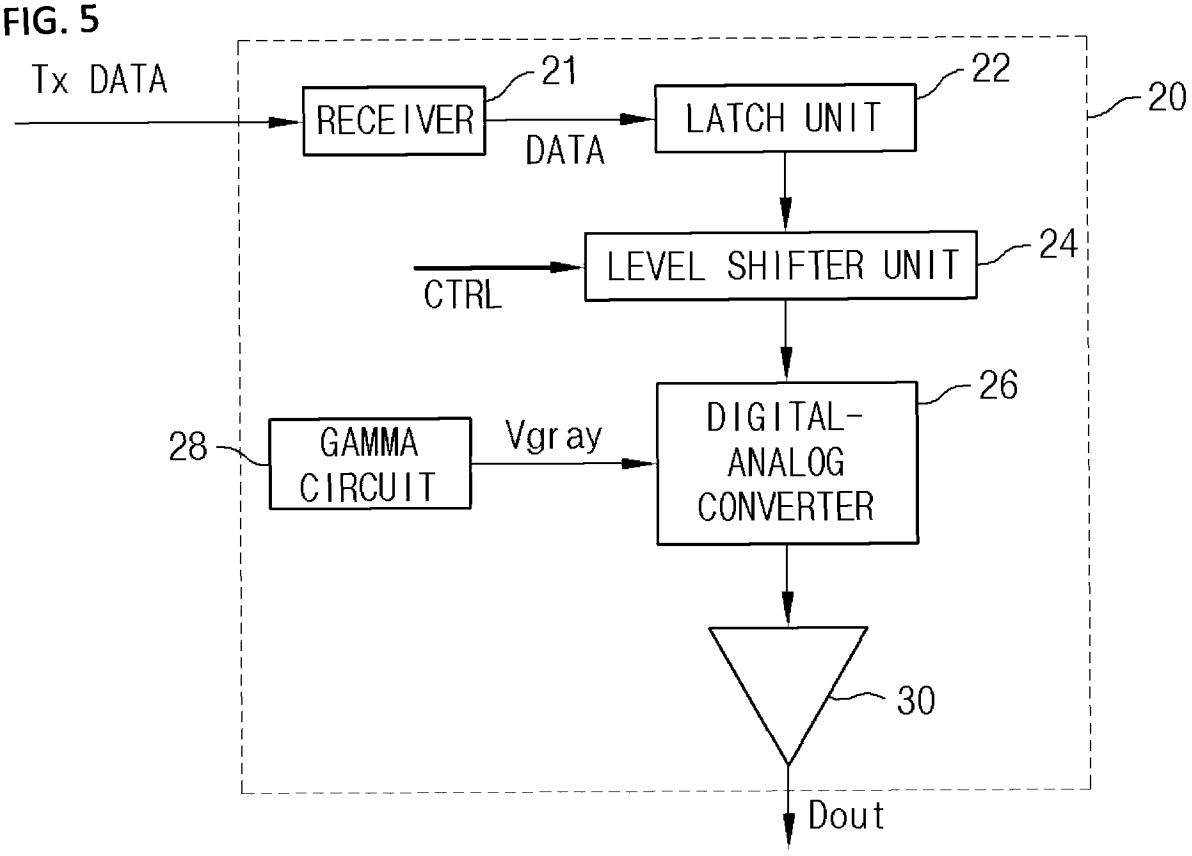

The driving circuit of FIG. 5 includes the receiver 21, the latch unit 22, the level shifter unit 24, the digital-analog converter 26, the gamma circuit 28 and the buffer unit 30, like the driving circuit of FIG. 3. However, the driving circuit of FIG. 5 is different from the driving circuit of FIG. 3 in that the control option CTRL is provided to the level shifter unit 24. While the components and operations of FIG. 5 are described, the duplicated descriptions of the same components and operations as those of FIG. 3 will be omitted.

When the control option CTRL is provided as a pin option, the control option CTRL may be provided to the level shifter unit 24 from the timing controller 10.

Furthermore, when the control option CTRL is provided in the form of a packet, the control option CTRL recovered by the receiver 21 may be provided to the level shifter unit 24.

In the driving circuit of FIG. 5, the level shifter unit 24 outputs a 10-bit signal corresponding to the 8-bit pixel data and the 2-bit control option.

Thus, the latch unit 22 includes latches corresponding to the 8-bit pixel data DATA, and provides latch information corresponding to the 8-bit pixel data DATA to the level shifter unit 24.

The level shifter unit 24 includes level shifters (not illustrated) corresponding to 10 bits, performs level-shifting on the 2-bit control option CTRL and the 8-bit pixel data DATA provided from the latch unit 22, and has an output corresponding to 10 bits. Then, the digital-analog converter 26, the gamma circuit 28 and the buffer unit 30 may have a configuration corresponding to the 10-bit output of the level shifter unit 24.

Thus, the level shifter unit 24 may output a 10-bit signal which is changed according to the value of the control option CTRL, in response to the 8-bit latch information having the same value.

More specifically, the control option CTRL may have four kinds of values such as $(00)_2$, $(01)_2$, $(10)_2$ and $(11)_2$. Thus, even when the 8-bit latch information having the same value is provided from the latch unit 22, the level shifter unit 24 may output a 10-bit signal to express four kinds of different gray scale values according to the value of the control option CTRL. Therefore, the output voltage Dout of the driving circuit 20 may be determined by the 10-bit output signal outputted from the level shifter unit 24.

The driving circuit of FIG. 5 may also combine the control option CTRL and the pixel data DATA, thereby expressing the gray scale with a larger number of gray scale values than the number of gray scale values which can be expressed by the given pixel data.

Furthermore, the receiver 21 can recover pixel data having a small number of bits, and the latch unit 22 may latch the pixel data having a small number of bits. Thus, the driving circuit of FIG. 5 can reduce the operation frequency and the power consumption, simplify the configuration of the delay circuit or latch for recovering the pixel data of the receiver, improve the chip size, and reduce the manufacturing cost thereof.

Figure 6:
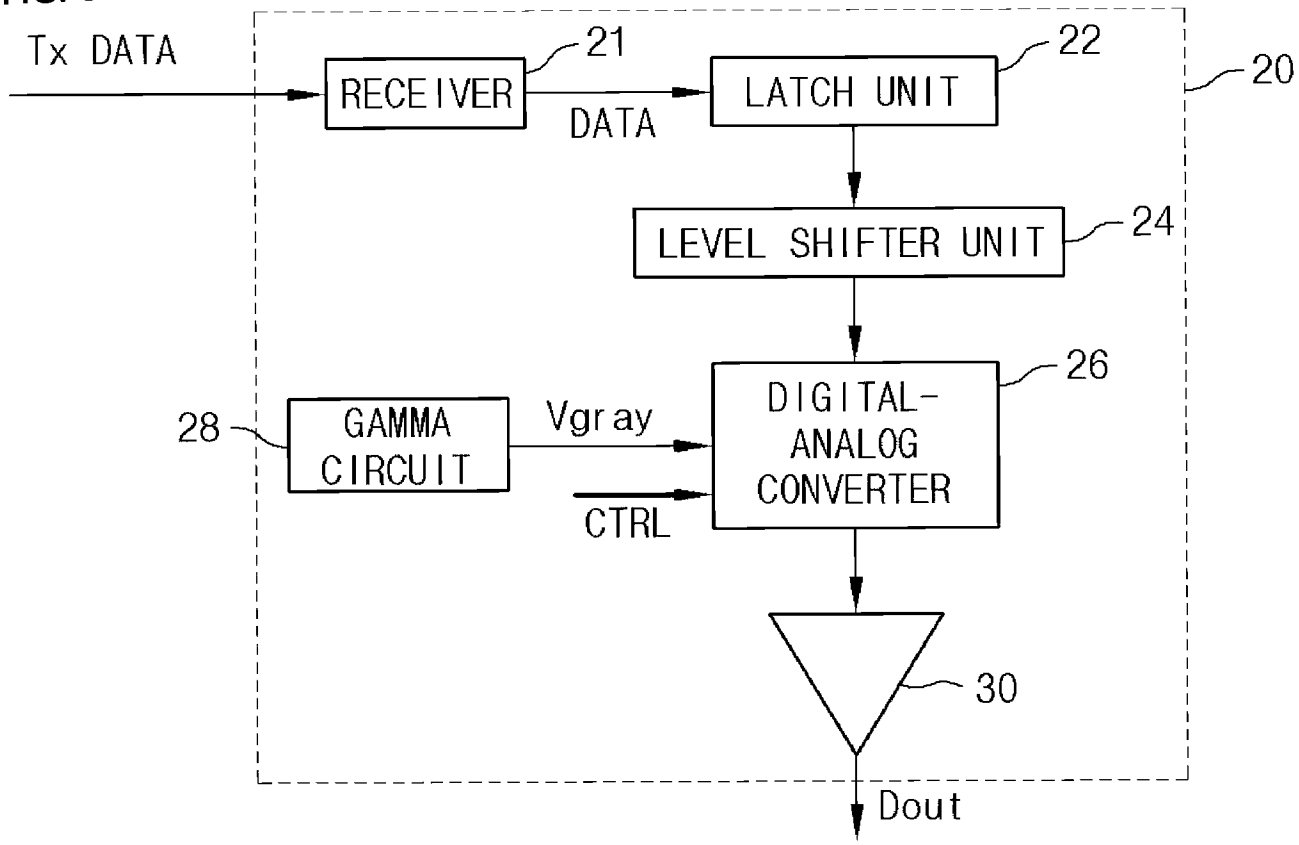

The driving circuit of FIG. 6 includes the receiver 21, the latch unit 22, the level shifter unit 24, the digital-analog converter 26, the gamma circuit 28 and the buffer unit 30, like the driving circuit of FIG. 3. However, the driving circuit of FIG. 6 is different from the driving circuit of FIG. 3 in that the control option CTRL is provided to the digital-analog converter 26. While the components and operations of FIG. 6 are described, the duplicated descriptions of the same components and operations as those of FIG. 3 will be omitted. When the control option CTRL is provided as a pin option, the control option CTRL may be provided to the digital-analog converter 36 from the timing controller 10.

Furthermore, when the control option CTRL is provided in the form of a packet, the control option CTRL recovered by the receiver 21 may be provided to the digital-analog converter 36.

In the driving circuit of FIG. 6, the gray scale is determined by the digital-analog converter 26.

Thus, the latch unit 22 includes latches corresponding to the 8-bit pixel data DATA, and provides latch information corresponding to the 8-bit pixel data DATA to the level shifter unit 24.

The level shifter unit 24 includes level shifters (not illustrated) corresponding to 8 bits, performs level-shifting on the 8-bit pixel data DATA provided from the latch unit 22, and has an output corresponding to 8 bits.

The digital-analog converter 26 has an input terminal corresponding to 10 bits, selects a gray voltage Vgray corresponding to a combination of the 2-bit control option CTRL and the 8-bit output of the level shifter unit 24, and outputs the selected gray voltage Vgray to the buffer unit 30.

Then, the gamma circuit 28 and the buffer unit 30 may have a configuration corresponding to the 10-bit output of the level shifter unit 24.

Thus, the digital-analog converter 26 may output an analog voltage which is changed according to the value of the control option CTRL, in response to the output of the level shifter unit 25 corresponding to the 8-bit pixel data DATA having the same value. More specifically, the control option CTRL may have four kinds of binary values such as $(00)_2$, $(01)_2$, $(10)_2$ and $(11)_2$. Thus, although the output of the level shifter unit 24, corresponding to the 8-bit pixel data DATA having the same value, is provided, the digital-analog converter 26 may output an analog voltage to express four kinds of different gray scale values according to the binary values of the control option CTRL. Therefore, the output voltage Dout of the driving circuit 20 may be determined by the analog voltage outputted from the digital-analog converter 26.

The driving circuit of FIG. 6 can also combine the control option CTRL and the pixel data DATA, thereby expressing the gray scale with a larger number of gray scale values than the number of gray scale values which can be expressed by the given pixel data.

Furthermore, the receiver 21 can recover pixel data having a small number of bits, the latch unit 22 can latch pixel data having a small number of bits, and the level shifter unit 24 may perform a level shifting operation corresponding to latch information having a small number of bits. Thus, the driving circuit of FIG. 6 can reduce the operation frequency and the power consumption, simplify the configuration of the delay circuit, the latch of the latch unit and the level shifter of the level shifter unit 24 for recovering the pixel data of the receiver, improve the chip size, and reduce the manufacturing cost thereof.

Figure 7:
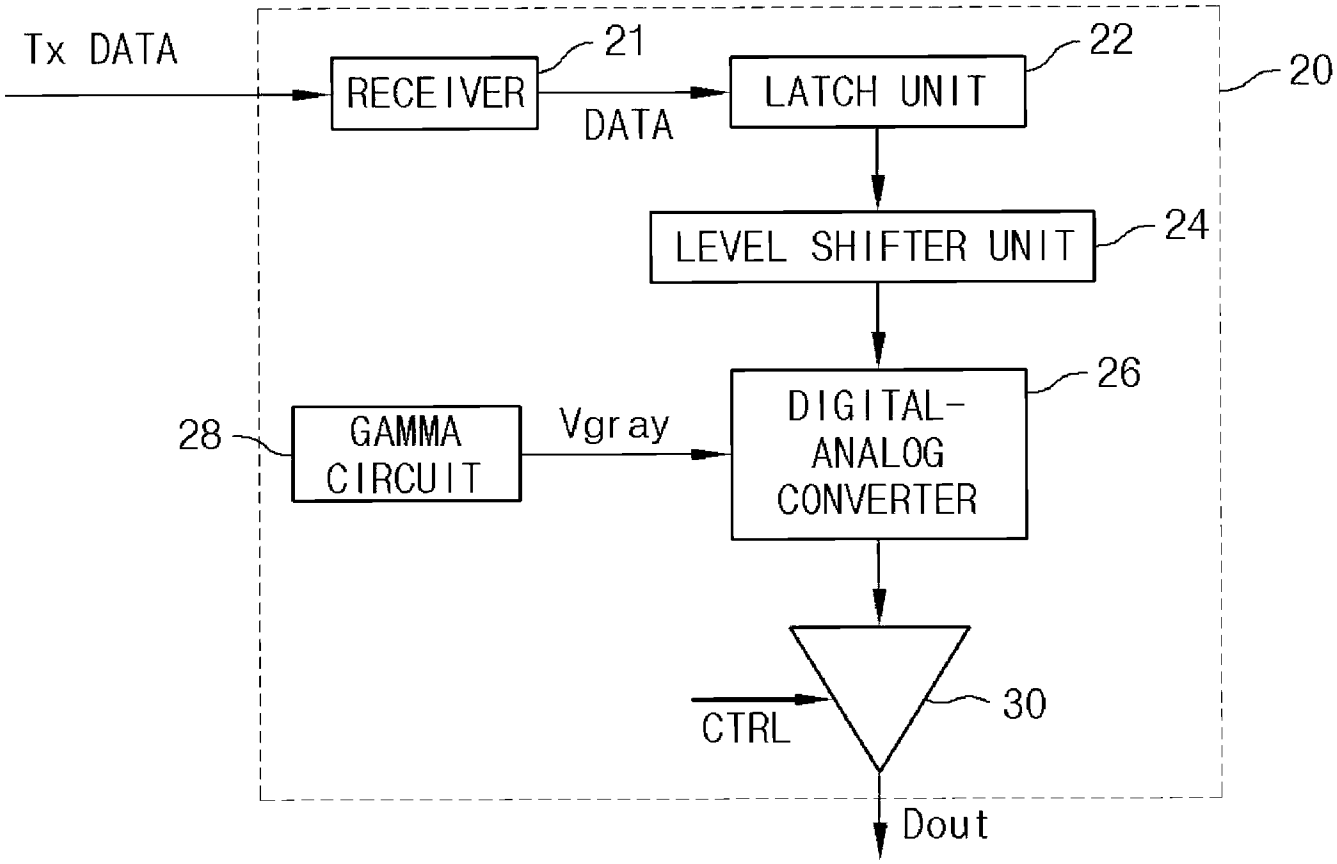

The driving circuit of FIG. 7 includes the receiver 21, the latch unit 22, the level shifter unit 24, the digital-analog converter 26, the gamma circuit 28 and the buffer unit 30, like the driving circuit of FIG. 3. However, the driving circuit of FIG. 7 is different from the driving circuit of FIG. 3 in that the control option CTRL is provided to the buffer unit 30. While the components and operations of FIG. 7 are described, the duplicated descriptions of the same components and operations as those of FIG. 3 will be omitted.

When the control option CTRL is provided as a pin option, the control option CTRL may be provided to the buffer unit 30 from the timing controller 10.

Furthermore, when the control option CTRL is provided in the form of a packet, the control option CTRL recovered by the receiver 21 may be provided to the buffer unit 30.

In the driving circuit of FIG. 7, the buffer unit 30 outputs an output voltage Dout which is changed according to the value of the control option CTRL.

Thus, the latch unit 22 includes latches corresponding to 8-bit pixel data DATA, and provides latch information corresponding to the 8-bit pixel data DATA to the level shifter unit 24.

The level shifter unit 24 includes level shifters (not illustrated) corresponding to 8 bits, performs level-shifting on the 8-bit pixel data DATA provided from the latch unit 22, and has an output corresponding to 8 bits.

The digital-analog converter 26 has an input terminal corresponding to 8 bits, selects a gray voltage Vgray corresponding to the 8-bit output of the level shifter unit 24, and outputs the selected gray voltage to the buffer unit 30. At this time, the gamma circuit 28 may also be configured to provide a gray voltage which can be expressed as 8 bits.

Although an analog voltage of the digital-analog converter 26 is inputted, the analog voltage corresponding to the 8-bit pixel data DATA having the same value, the buffer unit 30 may output an output voltage Dout which is changed according to the value of the control option CTRL.

More specifically, the control option CTRL may have four kinds of binary values such as $(00)_2$, $(01)_2$, $(10)_2$ and $(11)_2$. Thus, although an analog voltage of the digital-analog converter 26 are inputted, the analog voltage corresponding to the 8-bit pixel data DATA having the same value, the buffer unit 30 may output the output voltage Dout to express four kinds of different gray scale values according to the value of the control option CTRL.

As described above, the driving circuit of FIG. 7 can also express the gray scale with a larger number of gray scale values than the number of gray scale values which can be expressed by the given pixel data.

The receiver 21 can recover pixel data having a small number of bits, the latch unit 22 can latch the pixel data having a small number of bits, the level shifter unit 24 can perform a level shifting operation on the latch information having a small number of bits, the digital-analog converter 26 can output an analog voltage corresponding to an output of the level shifter unit 24, which has a small number of bits, and the gamma circuit 28 can provide a gray voltage corresponding to the small number of bits.

Therefore, the driving circuit of FIG. 7 can reduce the operation frequency and the power consumption, simplify the configuration of the delay circuit, the latch of the latch unit, the level shifter of the level shifter unit 24, the digital-analog converter 26 and the gamma circuit 28, which are used to recover the pixel data of the receiver, improve the chip size, and reduce the manufacturing cost thereof.

Figure 8:
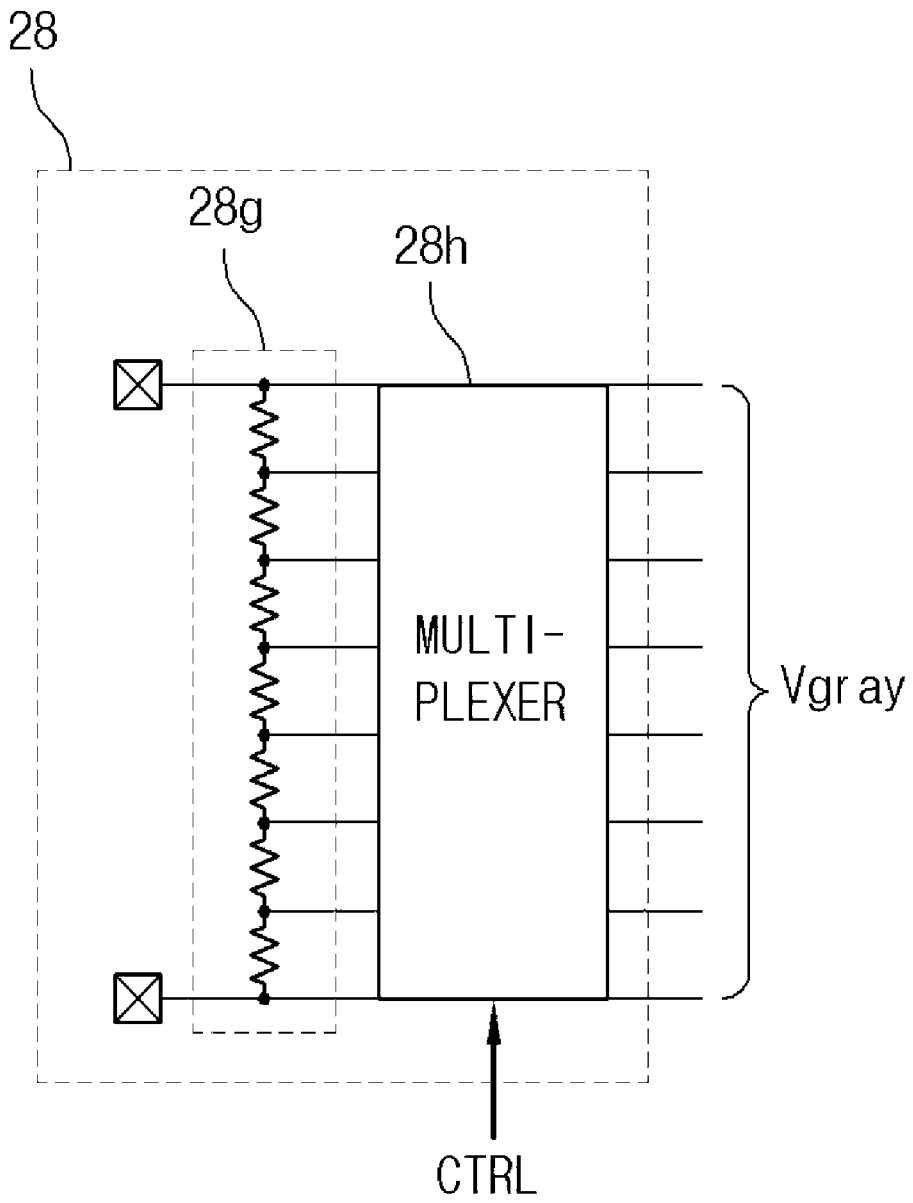
FIG. 8 is a block diagram illustrating that a control option is applied to a gamma circuit.

FIG. 8 illustrates an embodiment in which the control option CTRL is provided to the gamma circuit 28.

When the control option CTRL is provided as a pin option, the control option CTRL may be provided to the gamma circuit 28 from the timing controller 10.

Furthermore, when the control option CTRL is provided in the form of a packet, the control option CTRL recovered by the receiver 21 may be provided to the gamma circuit 28.

In the embodiment of FIG. 8, the gamma circuit 28 may include a multiplexer unit **28*h* and a resistor string 28*g***.

The resistor string **28*g* includes resistors coupled in series, and is configured to divide a voltage biased to the entire resistors and provide a gray voltage to the multiplexer unit 28*h* for each node. The resistor string 28*g* may provide gray voltages, of which the number corresponds to a gray scale corresponding to 10 bits, to the multiplexer unit 28*h***.

The multiplexer unit **28*h* selects gray voltages Vgray of which the number corresponds to a gray scale corresponding to 8 bits, among the gray voltages of the resistor string 28*g*, and transmits the selected gray voltages to the digital-analog converter 26**. According to the value of the control option CTRL, selected gray voltages Vgray may be changed.

The control option CTRL may selectively have four kinds of binary values such as $(00)_2$, $(01)_2$, $(10)_2$ and $(11)_2$. When the control option CTRL has a value of $(00)_2$, the multiplexer unit **28*h* may select gray voltages in the lowest gray scale range and output the selected voltages. When the control option CTRL is changed to $(01)_2$, $(10)_2$ and $(11)_2$, the multiplexer unit 28*h* may select gray voltages in different gray scale ranges, respectively, and output the selected voltages. When the value of the control option CTRL is changed in order of $(00)_2$, $(01)_2$, $(10)_2$ and $(11)_2$, the multiplexer unit 28*h*** may select gray voltages in increasing gray scale ranges.

In this way, the gray voltages outputted from the multiplexer unit **28*h*** may be changed by the control portion CTRL.

In this case, the receiver 21, the latch unit 22, the level shifter unit 24 and the digital-analog converter 26 may have a configuration corresponding to 8-bit pixel data DATA, and the digital-analog converter 26 may select a gray voltage Vgray provided from the multiplexer unit **28*h* in response to an output of the level shifter unit 24**, corresponding to the 8-bit pixel data DATA, and output an analog voltage.

At this time, the gray voltage Vgray provided to the digital-analog converter 26 has a gray scale which is changed according to the control option CTRL. Thus, although the same output of the level shifter unit 24 is inputted, the digital-analog converter 26 may output a different level of analog voltage according to the changed gray voltage Vgray. As a result, the gray voltage selection result of the gamma circuit 28 may be reflected into the analog voltage outputted from the digital-analog converter 26.

As described above, the driving circuit of FIG. 8 can also express the gray scale with a larger number of gray scale values than the number of gray scale values which can be expressed by the given pixel data.

Furthermore, the receiver 21 can recover pixel data having a small number of bits, the latch unit 22 can latch pixel data having a small number of bits, the level shifter unit 24 can perform level-shifting on the latch information having the small number of bits, and the digital-analog converter 26 can output an analog voltage corresponding to the output of the level shifter unit 25, which has a small number of bits.

Therefore, the driving circuit of FIG. 8 can reduce the operation frequency and the power consumption, simplify the configurations of the delay circuit, the latch of the latch unit, the level shifter of the level shifter unit 24 and the digital-analog converter 26, which are used to recover the pixel data of the receiver, improve the chip size, and reduce the manufacturing cost thereof.

The embodiments of the present invention may be applied to a case in which the gamma circuit 28 is implemented with a programmable gamma circuit. The programmable gamma circuit may be configured to provide a gray voltage Vgray according to gamma data. In this case, the embodiments of the present invention may be configured to provide a control option CTRL to components included in the programmable gamma circuit as illustrated in FIGS. 9 to 12. Hereafter, the programmable gamma circuit of FIGS. 9 to 12 will be referred to as a gamma circuit.

Figure 9:
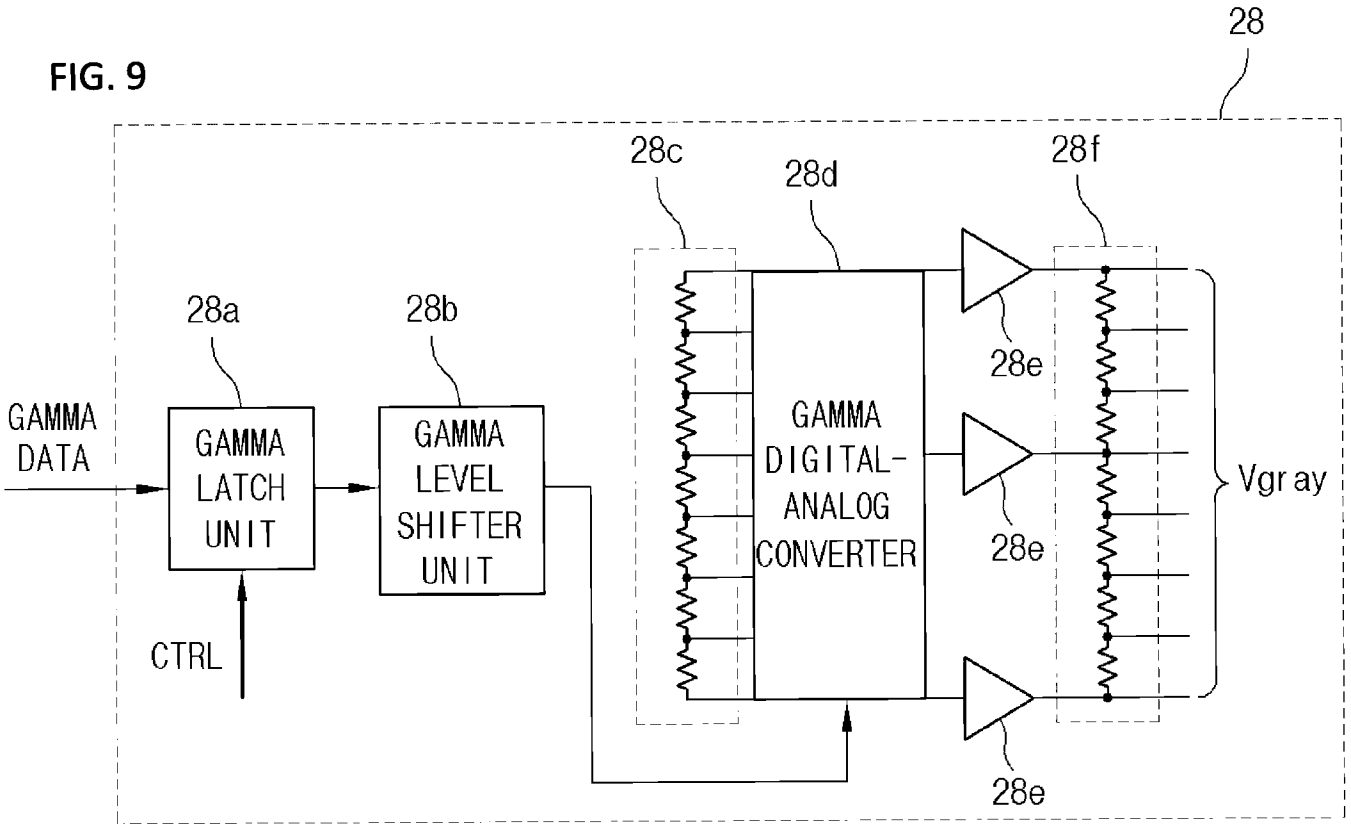
FIGS. 9 to 12 are block diagrams illustrating embodiments in which a control option is applied in the case of a programmable gamma circuit.

FIG. 9 is a block diagram illustrating the gamma circuit of FIG. 3.

The gamma circuit 28 of FIG. 9 may provide a voltage to the digital-analog converter 26, and perform gamma correction corresponding to gamma data.

The gamma circuit 28 may include a gamma latch unit 28*a*, a gamma level shifter unit 28*b*, a gamma resistor string 28*c*, a gamma digital-analog converter 28*d*, gamma buffer units 28*e* and a resistor string 28*f*.

The gamma latch unit 28*a* latches gamma data provided from the timing controller 10 or outside, and then provided the latched data to the gamma level shifter unit 28*b*.

The gamma level shifter unit 28*b* level-shifts the latch information provided from the gamma latch unit 28*a* according to the size of the gamma digital-analog converter 28*d*, and provides the shifted information to the gamma digital-analog converter 28*d*.

The gamma resistor string 28*c* includes resistors coupled in series, and is configured to divide a voltage biased to the entire resistors and provide a gray voltage for each node. The gamma resistor string 28*c* may be configured to provide voltages, of which the number can be used to generate a gamma reference voltage, to the gamma digital-analog converter 28*d*.

The gamma digital-analog converter 28*d* may be configured to provide a first reference gamma voltage for expressing the maximum value of a positive scale, a second reference gamma voltage for expressing the minimum value of a negative scale, and a third reference gamma voltage for expressing the intermediate value between the positive scale and the negative scale. At this time, the gray scale may be divided into the positive scale and the negative scale, a voltage range between the first and third reference gamma voltages may be defined as the positive scale, and a voltage range between the second and third reference gamma voltages may be defined as the negative scale.

In the above-described example, the gamma digital-analog converter 28*d* may selectively output the voltages provided from the gamma resistor string 28*c* as the first to third reference gamma voltages according to the signal provided from the gamma level shifter unit 28*b*.

The respective gamma buffer units 28*e* are configured to transmit the first to third reference gamma voltages provided from the gamma digital-analog converter 28*d* to the resistor string 28*f*.

The resistor string 28*f* includes resistors connected in series. Among the resistors, resistors across which the first and third gamma voltages are connected may provide gray voltages for expressing a positive scale through the respective nodes, and resistors across which the second and third gamma reference voltages are connected may provide gray voltages for expressing a negative scale through the respective nodes. At this time, the resistor string 28*f* may provide gray voltages Vgray, of which the number corresponds to a value for expressing a gray scale corresponding to 8-bit pixel data DATA, to the digital-analog converter 26.

According to the configuration of the gamma circuit 28, the digital-analog converter 26 selects a gray voltage Vgray corresponding to the 8-bit pixel data, and outputs the selected analog voltage to the buffer unit 30.

The gamma circuit 28 of FIG. 9 is configured to provide the control option CTRL to the gamma latch unit 28*a*. As a result, the gray scale is changed by the gamma latch unit 28*a*.

More specifically, the gamma latch unit 28*a* provides latch information to the gamma level shifter unit 28*b*, the latch information being obtained by combining the control option CTRL and gamma data.

The gamma digital-analog converter 28*d* may selectively output the voltages provided from the gamma resistor string 28*c* as the first to third reference gamma voltages according to the signal provided from the gamma level shifter unit 28*b*, in response to the latch information into which the control option CTRL is reflected. That is, the first to third reference gamma voltages outputted from the gamma digital-analog converter 28*d* may be changed by the control option CTRL. As a result, the gray scale of the gamma voltage Vgray provided from the resistor string 28*f* is changed.

The digital-analog converter 26 outputs the gamma voltage Vgray having the gray scale changed by the control option CTRL as the selected analog voltage, and the gray scale of the analog voltage outputted from the digital-analog converter 26 has the changed value.

Figure 10:
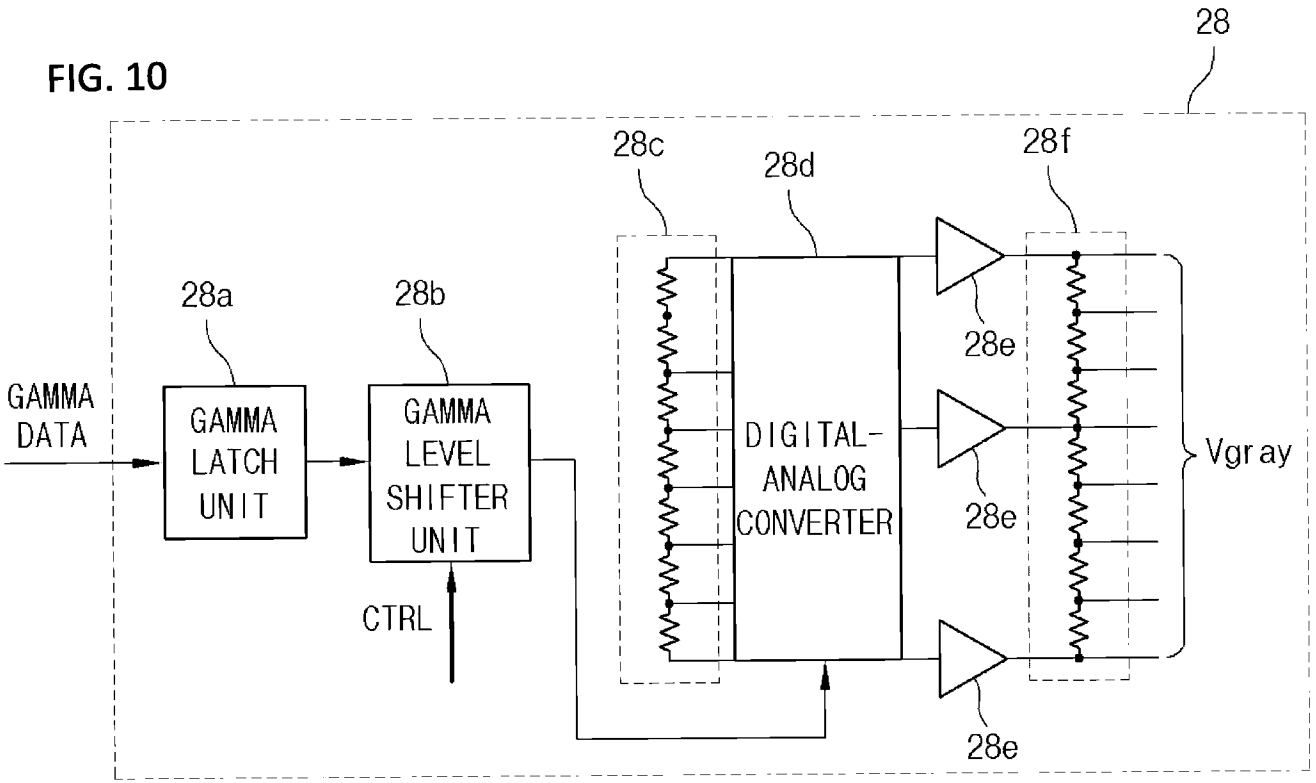

The gamma circuit of FIG. 10 includes the gamma latch unit 28*a*, the gamma level shifter unit 28*b*, the gamma resistor string 28*c*, the gamma digital-analog converter 28*d*, the gamma buffer unit 28*e* and the resistor string 28*f*, like the gamma circuit of FIG. 9. However, the gamma circuit of FIG. 10 is different from the gamma circuit of FIG. 9 in that the control option CTRL is provided to the gamma level shifter unit 28*b*. While the components and operations of FIG. 10 are described, the duplicated descriptions of the same components and operations as those of FIG. 9 will be omitted.

In the gamma circuit of FIG. 10, the gray scale is changed by the gamma level shifter unit 28*b*.

More specifically, the gamma level shifter unit 28*b* performs level-shifting on the latch information of the 2-bit control option CTRL and the gamma data provided from the gamma latch unit 28*a*.

Thus, although the same latch information is received from the gamma latch unit 28*a*, the gamma level shifter unit 24 may output a signal which is changed in response to the value of the control option CTRL. That is, the first to third reference gamma voltages outputted from the gamma digital-analog converter 28*d* may be changed by the control option CTRL, and the gray scale of the gamma voltage Vgray provided from the resistor string 28*f* is changed by the control option CTRL.

The digital-analog converter 26 outputs the gamma voltage Vgray having the gray scale changed by the control option CTRL as a selected analog voltage, and the analog voltage outputted from the digital-analog converter 26 has a value to which the changed gray scale is applied.

Figure 11:
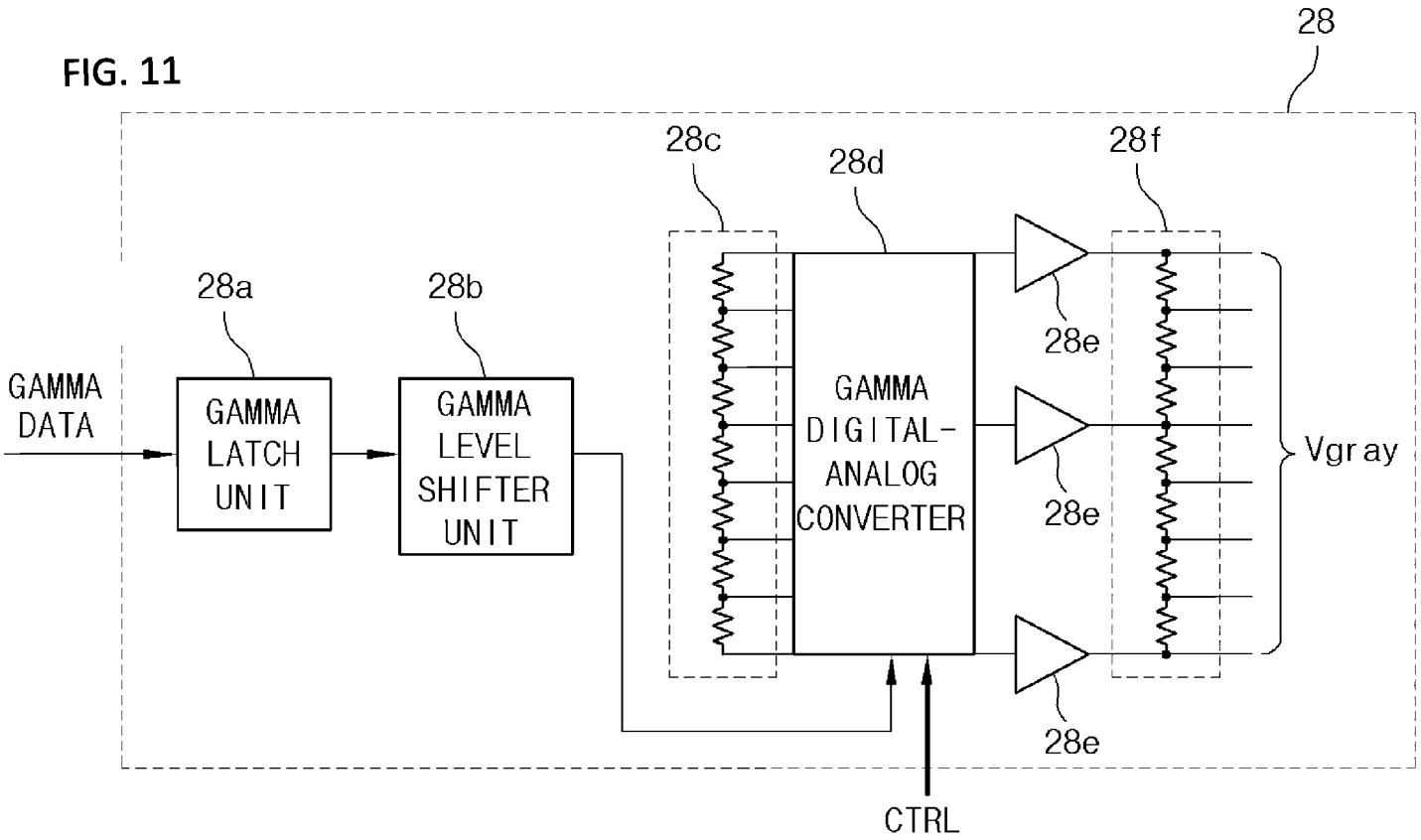

The gamma circuit of FIG. 11 includes the gamma latch unit 28*a*, the gamma level shifter unit 28*b*, the gamma resistor string 28*c*, the gamma digital-analog converter 28*d*, the gamma buffer unit 28*e* and the resistor string 28*f*, like the gamma circuit of FIG. 9. However, the gamma circuit of FIG. 11 is different from the gamma circuit of FIG. 9 in that the control option CTRL is provided to the gamma digital-analog converter 28*d*. While the components and operations of FIG. 11 are described, the duplicated descriptions of the same components and operations as those of FIG. 9 will be omitted.

In the gamma circuit of FIG. 11, the gray scale is changed by the gamma digital-analog converter 28*d*.

More specifically, the gamma digital-analog converter 28*d* outputs the first to third reference gamma voltages selected by the 2-bit control option CTRL and an output of the gamma level shifter unit 28*b*, and the gray scale of the gamma voltage Vgray provided from the resistor string 28*f* is changed by the control option CTRL.

The digital-analog converter 26 outputs the gamma voltage Vgray having the gray scale changed by the control option CTRL as a selected analog voltage, and the analog voltage outputted from the digital-analog converter 26 has a value to which the changed gray scale is applied.

Figure 12:
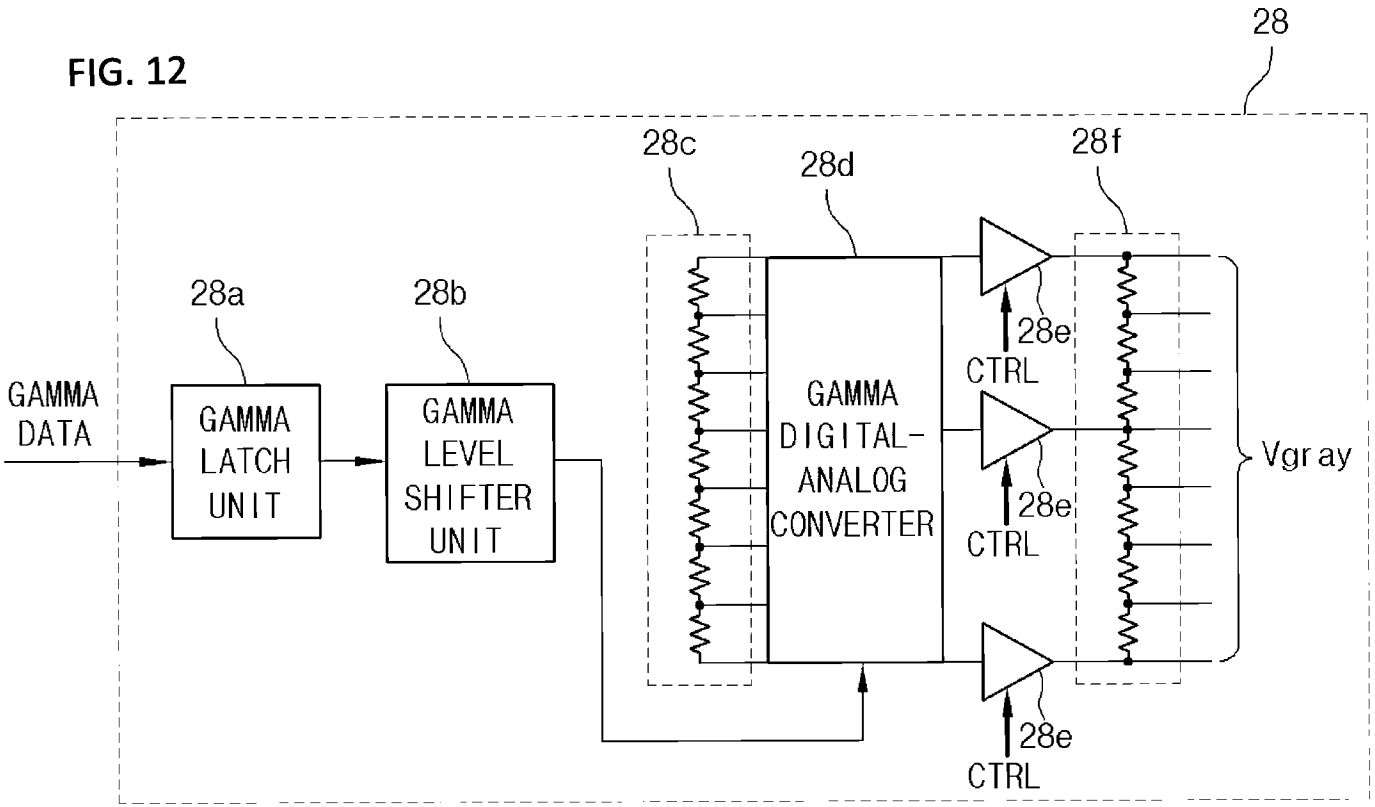

The gamma circuit of FIG. 12 includes the gamma latch unit 28*a*, the gamma level shifter unit 28*b*, the gamma resistor string 28*c*, the gamma digital-analog converter 28*d*, the gamma buffer unit 28*e* and the resistor string 28*f*, like the gamma circuit of FIG. 9. However, the gamma circuit of FIG. 12 is different from the gamma circuit of FIG. 9 in that the control option CTRL is provided to the gamma buffer unit 28*e*. While the components and operations of FIG. 12 are described, the duplicated descriptions of the same components and operations as those of FIG. 9 will be omitted.

In the gamma circuit of FIG. 12, the gray scale is changed by the gamma buffer unit 28*e*.

The gamma buffer unit 28*e* changes the first to third reference gamma voltages in response to the value of the control option CTRL and outputs the changed reference gamma voltages. As a result, the gray scale of the gamma voltage Vgray outputted from the resistor string 28*f* is changed by the control option CTRL. Thus, although the same output of the level shifter unit 24 is inputted, the digital-analog converter 26 may output a different level of analog voltage according to the changed gray voltage Vgray.

The gamma circuits of FIGS. 9 to 12 may perform the gray scale change using the control option CTRL, and the driving circuit 20 may express the gray scale with a larger number of gray scale values than the number of gray scale values which can be expressed by the given pixel data.

Figure 13:
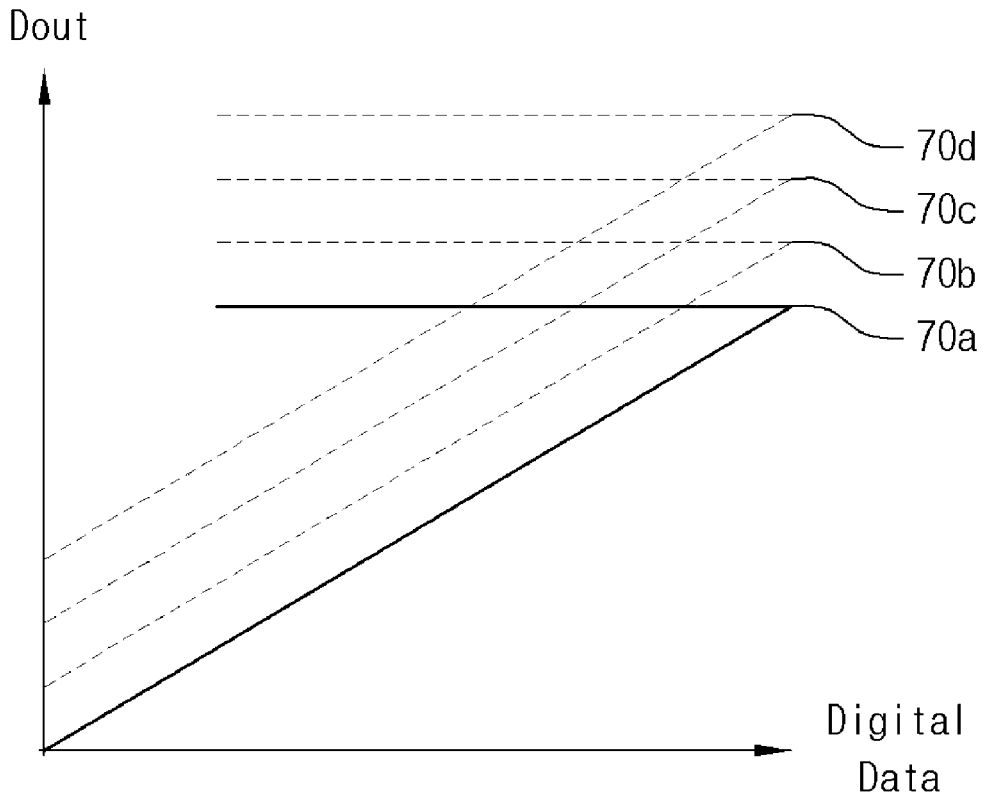
FIG. 13 is a graph illustrating voltage changes according to another embodiment of the present invention.

FIG. 13 illustrates variations of the output voltage Dout outputted from the driving circuit 20, when the gray scale is changed by the control option CTRL.

When the same pixel data DATA are provided, the output voltage Dout may be outputted at a level which is differently shifted according to the value of the control option CTRL.

For example, when any one of the components included in the analog unit receives the control option CTRL and the control option CTRL is divided into $(00)_2$, $(01)_2$, $(10)_2$ and $(11)_2$, the output voltage Dout may be outputted at different levels as indicated by 70*a*, 70*b*, 70*c* and 70*d*, according to the value of the control option CTRL.

According to the embodiments of the present invention, the display apparatus and the driving circuit thereof can use the control option to express a gray scale with a larger number of gray scale values than the number of gray scale values expressed by given pixel data.

Furthermore, the display apparatus and the driving circuit thereof can express a gray scale with a larger number of gray scales than the number of gray scale values which can be expressed by pixel data, using the control option. Thus, the display apparatus and the driving circuit thereof can reduce the operation frequency of the driving circuit and the power consumption of the driving circuit, improve the chip size of the driving circuit, simplify the configuration and design of the driving circuit, and reduce the manufacturing cost of the driving circuit.

While various embodiments have been described above, it will be understood to those skilled in the art that the embodiments described are by way of example only. Accordingly, the disclosure described herein should not be limited based on the described embodiments.

What is claimed is:

1. A display apparatus comprising:

a timing controller configured to divide an input signal, including information for expressing a pixel with a second gray scale, into pixel data with a first gray scale and a control option and to provide the pixel data and the control option in the form of a packet to a driving circuit; and the driving circuit configured to output an output voltage according to a combination of the pixel data and the control option, the output voltage having the second gray scale including a larger number of gray scale values than the number of gray scale values expressed by the first gray scale of the pixel data;

wherein the timing controller comprises:

a control unit configured to receive the input signal provided from outside and output the pixel data and the control option which are contained in the input signal;

a pixel data processing unit configured to convert the pixel data of the control unit, outputted in parallel, into serial data;

a control option processing unit configured to convert the control option of the control unit, outputted in parallel, into serial data; and an output unit configured to receive at least the pixel data of the pixel data processing unit and provide the received data to the driving circuit.

2. The display apparatus of claim 1, wherein the control option has a smaller number of bits than the pixel data.

3. The display apparatus of claim 1, wherein the timing controller provides the control option as a pin option to the driving circuit.

4. A display apparatus, comprising:

a timing controller configured to divide an input signal, including information for expressing a pixel with a second gray scale, into pixel data with a first gray scale and a control option to provide the pixel data and the control option in the form of a packet to a driving circuit; and the driving circuit, wherein the timing controller comprises:

a control unit configured to receive the input signal provided from outside and output the pixel data and the control option which are contained in the input signal;

a pixel data processing unit configured to convert the pixel data of the control unit, outputted in parallel, into serial data;

a control option processing unit configured to convert the control option of the control unit, outputted in parallel, into serial data; and an output unit configured to receive at least the pixel data of the pixel data processing unit and provide the received data to the driving circuit; and, wherein the driving circuit comprises:

a digital unit configured to perform a series of digital processes for the pixel data and output a digital signal corresponding to the pixel data; and an analog unit configured to perform a series of analog processes corresponding to the digital signal and output an output voltage corresponding to the digital signal, at least any one of the digital unit and the analog unit combines the control option and the pixel data, and the output voltage has the second gray scale including a larger number of gray scale values than the number of gray scale values expressed by the first gray scale of the pixel data, according to a combination of the control option and the pixel data.

5. The driving circuit of claim 4, wherein the digital unit comprises a latch unit configured to latch the pixel data and the control option, and the latch unit outputs latch information having the number of bits obtained by adding the pixel data and the control option.

6. The driving circuit of claim 4, wherein the digital unit comprises a level shifter unit configured to level-shift latch information and the control option, and the level shifter unit outputs a signal having the number of bits obtained by adding the latch information and the control option.

7. The driving circuit of claim 4, wherein the analog unit comprises a buffer unit configured to output the output voltage corresponding to an analog voltage which corresponds to a selected gray voltage, and the buffer unit outputs the output voltage to have a level which is changed in response to the control option.

8. The driving circuit of claim 4, wherein the analog unit comprises a gamma circuit configured to provide a gray voltage, and the gamma circuit provides the gray voltage of which the gray scale is changed in response to the control option at least one of the positive supply voltage, the middle voltage and the negative supply voltage as a switch control signal.

9. The driving circuit of claim 8, wherein the gamma circuit is implemented with a programmable gamma circuit for providing the gray voltage corresponding to gamma data.

10. The driving circuit of claim 4, further comprising a receiver configured to recover the pixel data from Tx data, wherein the control option is received as a pin option from outside.

11. The driving circuit of claim 4, further comprising a receiver configured to recover the pixel data and the control option from Tx data.

12. The driving circuit of claim 4, wherein the analog unit comprises a digital-analog converter configured to select a gray voltage in response to the digital signal and output the selected gray voltage as an analog voltage, and the digital-analog converter selects the gray voltage corresponding to the number of bits obtained by adding the digital signal and the control option, and outputs the selected gray voltage as the analog voltage.

13. The driving circuit of claim 4, further comprising a control option providing unit configured to provide the control option, wherein at least any one of the digital unit and the analog unit combines the control option and the pixel data.

14. The driving circuit of claim 13, wherein the control option providing unit performs any one of an operation of providing the control option in response to an external input, an operation of generating the control option using a value set therein and providing the generated control option, an operation of providing the control option using the pixel data, and an operation of providing the control option using a signal related to recovery of the pixel data.

15. A display apparatus, comprising:

a timing controller configured to divide an input signal, including information for expressing a pixel with a second gray scale, into pixel data with a first gray scale and a control option to provide the pixel data and the control option in the form of a packet to a driving circuit; and the driving circuit, wherein the timing controller comprises:

a control unit configured to receive the input signal provided from outside and output the pixel data and the control option which are contained in the input signal;

a pixel data processing unit configured to convert the pixel data of the control unit, outputted in parallel, into serial data;

a control option processing unit configured to convert the control option of the control unit, outputted in parallel, into serial data; and an output unit configured to receive at least the pixel data of the pixel data processing unit and provide the received data to the driving circuit; and, wherein the driving circuit comprises:

a latch unit configured to latch at least pixel data with the first gray scale and provide latch information;

a level shifter unit configured to perform level-shifting on at least the latch information and output a digital signal;

a gamma circuit configured to provide a gray voltage;

a digital-analog converter configured to receive at least the output signal of the level shifter unit, select the gray voltage corresponding to the output signal of the level shifter unit, and output the selected gray voltage as an analog voltage; and a buffer unit configured to output the analog voltage as an output voltage, one of the latch unit, the level shifter unit, the gamma circuit, the digital-analog converter and the buffer unit combines the control option and the pixel data in order that the output voltage has the second gray scale including a larger number of gray scale values than the number of gray scale values expressed by the first gray scale of the pixel data, wherein among the latch unit, the level shifter unit, the gamma circuit, the digital-analog converter and the buffer unit, a circuit positioned before a combination of the control option and the pixel data is configured to correspond to the number of bits included in the pixel data with the first gray scale, and a circuit which combines the control option and the pixel data or performs an operation corresponding to the combination result is configured to correspond to a larger number of bits than that of the pixel data.

* * * * *